US008596833B1

(12) United States Patent
Cytrynowicz

(10) Patent No.: US 8,596,833 B1
(45) Date of Patent: Dec. 3, 2013

(54) INTERCHANGEABLE LAMP SHADE KIT, DISPLAY SYSTEM AND METHOD

(71) Applicant: Daniel Cytrynowicz, Los Angeles, CA (US)

(72) Inventor: Daniel Cytrynowicz, Los Angeles, CA (US)

( * ) Notice: Subject to any disclaimer, the term of this patent is extended or adjusted under 35 U.S.C. 154(b) by 0 days.

(21) Appl. No.: 13/757,641

(22) Filed: Feb. 1, 2013

Related U.S. Application Data

(60) Provisional application No. 61/738,997, filed on Dec. 18, 2012.

(51) Int. Cl.
*F21V 17/06* (2006.01)
*F21V 1/16* (2006.01)

(52) U.S. Cl.
USPC ..... 362/352; 362/356; 362/353; 156/218

(58) Field of Classification Search
USPC ..... 362/352, 358, 351, 356; 156/218
See application file for complete search history.

(56) References Cited

U.S. PATENT DOCUMENTS

| | | | |
|---|---|---|---|
| 1,580,922 | A | 4/1926 | Scherer |
| 1,583,568 | A | 5/1926 | Berkowitz |
| 2,586,389 | A | 2/1952 | Schear et al. |
| 2,637,805 | A | 5/1953 | Jacobs |
| 3,142,446 | A | 7/1964 | Okamoto |
| 3,764,801 | A | 10/1973 | Mainieks |
| 3,787,676 | A | 1/1974 | Korack |
| 4,075,684 | A | 2/1978 | Witz |
| 4,212,052 | A | 7/1980 | Chambard |
| 4,268,896 | A | 5/1981 | Mann |
| 4,745,532 | A | 5/1988 | Mo |
| 5,211,474 | A | 5/1993 | Leitner et al. |
| 5,662,412 | A | 9/1997 | Glendmyer |
| 6,000,817 | A | 12/1999 | Chan |
| 6,729,747 | B1 | 5/2004 | Wirayani |
| 6,786,621 | B2 | 9/2004 | Sviland |
| 7,347,593 | B1 | 3/2008 | Swanson |
| 2005/0016667 | A1 | 1/2005 | Dwight et al. |
| 2011/0131847 | A1 | 6/2011 | Acworth |

*Primary Examiner* — Tracie Y Green
(74) *Attorney, Agent, or Firm* — Lance M. Pritikin, Esq.

(57) ABSTRACT

An exemplary interchangeable lamp shade kit may comprise a lamp base, a spider element and a shade element with at least flat and deployed confirmations. The shade element includes opposing first and second ends with respective securement elements generally formed thereat and adapted to engage one another for releasably retaining the shade element in its cylindrical deployed configuration. A plurality of detent apertures in the shade element are adapted to receive respective detent elements radially distributed about the spider element. An exemplary system and method for displaying lamp shade kits may comprise a display element supportingly presenting a multiplicity of lamp bases, a plurality of spider elements, and an assortment of shade elements. The shade elements may be releasably suspended in their flat configurations in a linear or curved array for convenient review and selection by consumers positioned on a consumer pathway adjacent the display element.

37 Claims, 10 Drawing Sheets

INTERCHANGEABLE LAMP SHADE KIT, DISPLAY SYSTEM AND METHOD

RELATED APPLICATIONS

This application claims the benefit of U.S. Provisional Application No. 61/738,997, filed on Dec. 18, 2012, the contents of which are incorporated by this reference in its entirety for all purposes as if fully set forth herein.

TECHNICAL FIELD

The present invention relates generally to small lamps and methods of displaying lamp components and kits for sale in a retail environment.

BACKGROUND

Conventional tabletop or desktop lamps are typically shipped, displayed, and sold at retail with their lamp shades already formed in a cylindrical or other operationally deployed configuration. Many such conventional lamp shades incorporate one or more generally rigid frame elements to hold their cylindrical shape. Such frame elements may include, for example, one or more rigid hoops or similar structures which are permanently sewn, taped or glued to the remainder of the shade in order to provide permanent shape to the shade. In many cases, tape or fabric used to retain or conceal the hoops may undesirably obstruct the decorative pattern on the outer surface of the shade near, for example, the upper and lower edges of the shade. The fragility and bulkiness of such pre-formed conventional shade solutions may make them more expensive to ship to retail stores, and may render them inconvenient for the consumer to store while a replacement shade is temporarily in use. Such conventional shades may be easily damaged in a retail environment and take up a good deal of costly retail display space due to their bulkiness.

In a retail environment, efficient use of display space and the ability to attract and maintain the consumer's attention are key priorities. Moreover, some of the most effective retail display systems are those that compel a consumer to stop and physically engage the product offered for sale. Consumers who are in the market for attractive, inexpensive and readily-modifiable lighting solutions are often seeking a way to use their own home or office space more efficiently. Such consumers may therefore be particularly subconsciously drawn toward display systems in which limited space appears to be used with great efficiency.

What is needed is an interchangeable lamp shade kit in which the lamp shade is less expensive to produce, is more compact and durable during shipment and storage, is easier for a consumer to deploy and install on a lamp base while minimizing components required for assembly, and which allows the consumer to conveniently, inexpensively and repeatedly interchange one shade with another as their personal tastes or interests change. What is also needed is an improved system and method for displaying interchangeable lamp shade kits in a retail environment, wherein the display provides for a more efficient use of retail space to exhibit a greater variety of shade solutions, and compels a passing consumer to stop and interact with one or more components of the lamp shade kits.

SUMMARY

Certain deficiencies of the prior art may be overcome by the provision of one or more embodiments of an interchangeable lamp shade kit, display system and method.

An interchangeable lamp shade kit may comprise a shade element which may be flexible, translucent and have at least a flat configuration and a deployed configuration. The shade element may be substantially flat planar in its flat configuration and substantially cylindrical (e.g., right cylindrical or conically cylindrical) in its deployed configuration. The shade element may include opposing first and second ends. The first end may have one or more first securement elements in close proximity thereto, and the second end may have one or more second securement elements in close proximity thereto. The first securement elements may be configured to releasably engage respective second securement elements for releasably retaining the shade element in its deployed configuration. The first end may also have one or more first alignment elements in close proximity therewith, and the second end may have one or more second alignment elements close proximity therewith. Respective first and second alignment elements may be configured to releasably engage one another in, for example, tab-in-slot fashion to align the first and second ends with each other. Such alignment may ensure that the portion of the upper edge near the first end substantially aligns with the portion of the upper edge near the second end, and that the portion of the lower edge near the first end substantially aligns with the portion of the lower edge near the second end.

The shade element may include a plurality of detent apertures adapted to be in receiving engagement with respective detent elements of a spider element for providing at least lateral and vertical support of the shade element by the spider element. The detent element may comprise a generally vertically-extending notch adapted to receive a portion of a respective shade element adjacent a respective detent aperture. The shade element may be unitarily formed from a sheet of resilient polymer and may include an outer surface having a graphic design printed thereon. A shade element may be secured within a packaging element with the shade element being in its flat configuration, and the packaging element may have a hanger portion, such as a label cut-out or hook, by which the shade element may be releasably suspendable for display in a retail environment.

A system for displaying interchangeable lamp shade kits within a retail environment may comprise a multiplicity of lamp base elements, a plurality of spider elements and an assortment of shade elements. Each spider element may include a hub portion and a multiplicity of detent elements radially distributed thereabout. Each hub portion may be configured to be removably secured to a selected lamp base element. The shade elements may each be releasably suspended in their flat configurations for display in a retail environment. Each shade element may define a shade planar axis when in its flat configuration, and the shade elements may be arranged in an array in which the planar axes are substantially parallel to one another or tangent to a selected curve.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
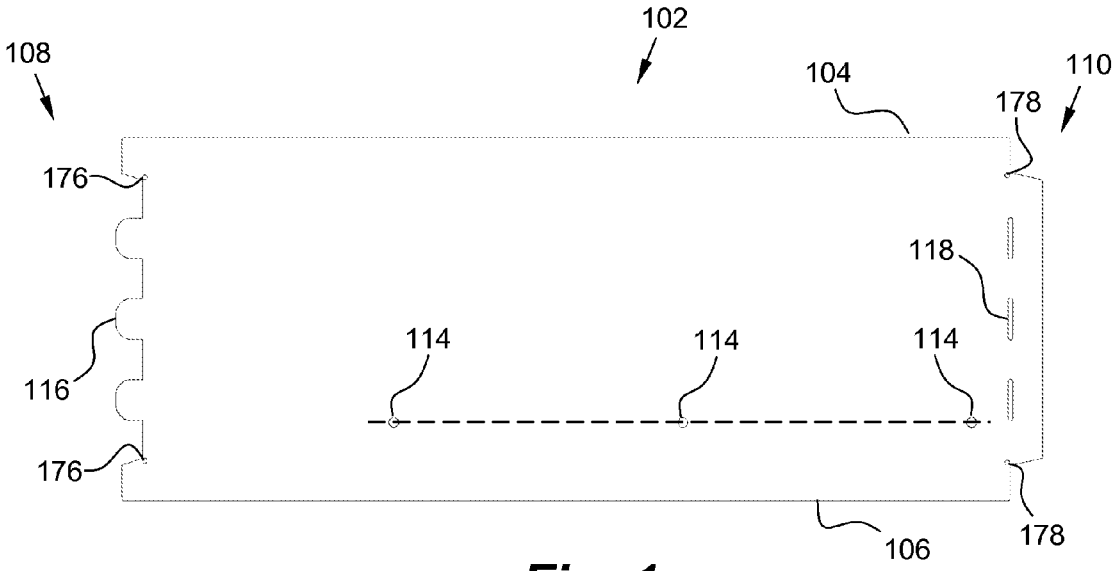
FIG. 1 is a diagrammatic plan view of one embodiment of a shade element in accordance with the present invention and shown in a flat configuration.

Referring now to the drawings, like reference numerals designate identical or corresponding features throughout the several views. Embodiments of a interchangeable lamp shade kit (example embodiments of which are depicted in assembled form at 100) may comprise one or more of a shade element 102, a spider element 130 and a base element (two particular variations of which are depicted in the FIGS. as 120*a* and 120*b*).

Figure 8:
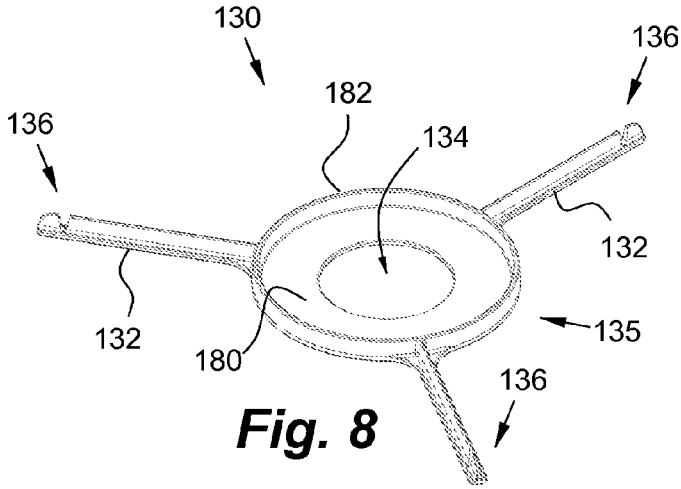
FIG. 8 is a diagrammatic perspective view of one particular embodiment of a spider element in accordance with the present invention.
Figure 9:
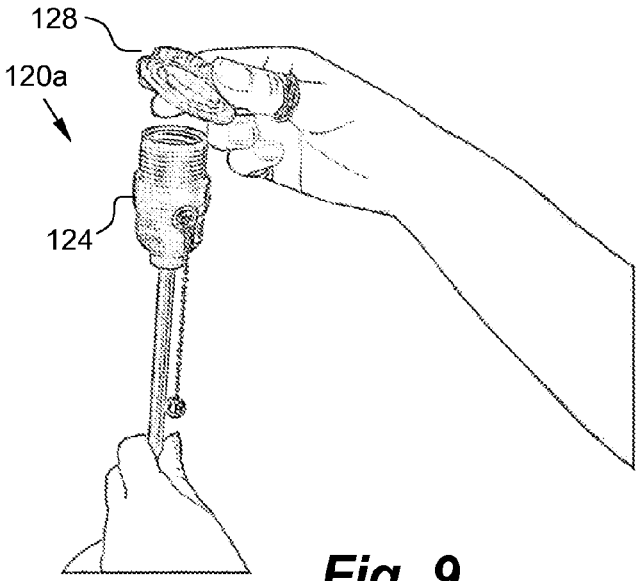
FIG. 9 is a diagrammatic perspective view depicting a retainer element being threadedly removed from the socket thread of a socket element by a user.
Figure 10:
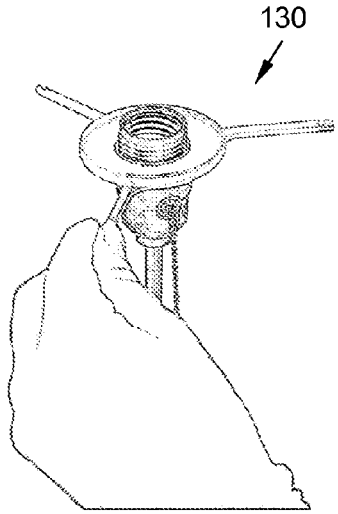
FIG. 10 is a diagrammatic perspective view depicting a spider element or prong adaptor being positioned such that the threaded portion of the socket element is received through the center aperture of the spider element.
Figure 11:
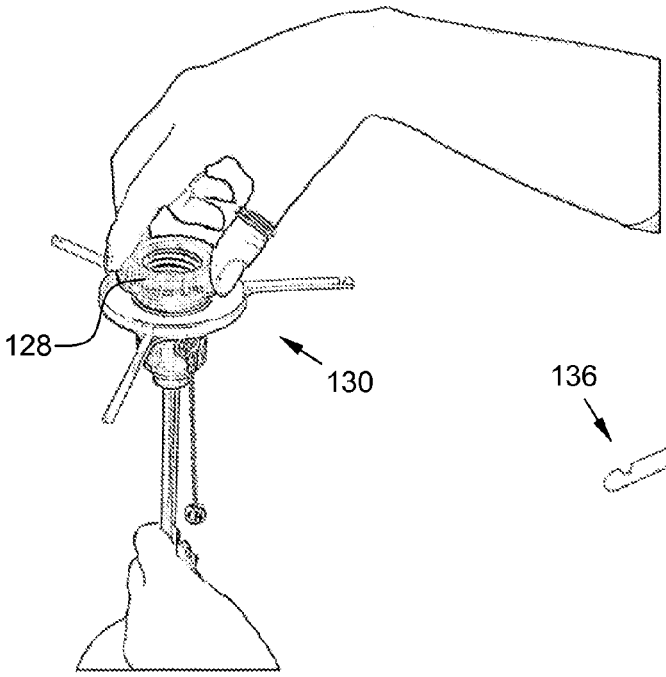
FIG. 11 is a diagrammatic perspective view depicting a retainer element being threadedly replaced on the socket thread of a socket element.
Figure 12:
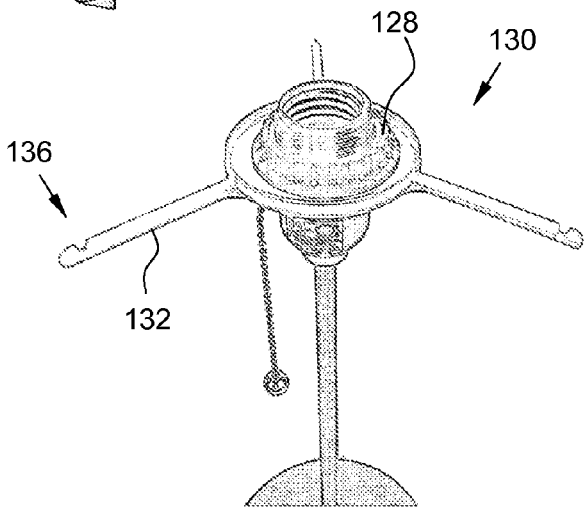
FIG. 12 is a diagrammatic perspective view depicting the retainer element threadedly tightened to secure the spider element in place with respect to the socket element.
Figure 13:
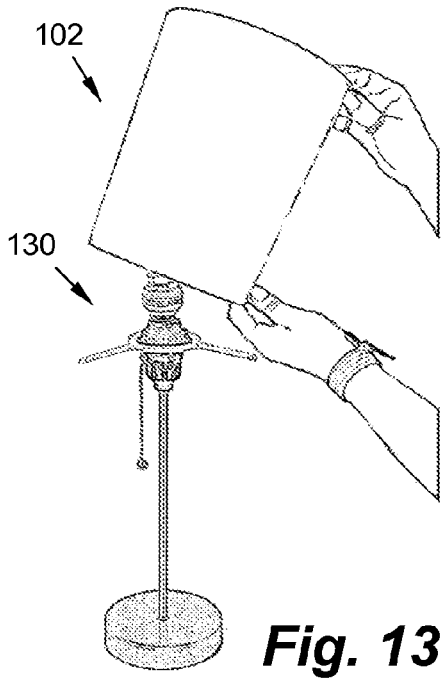
FIG. 13 is a diagrammatic perspective view depicting the shade element in its deployed configuration being placed over the base element toward engagement with the spider element.
Figure 14:
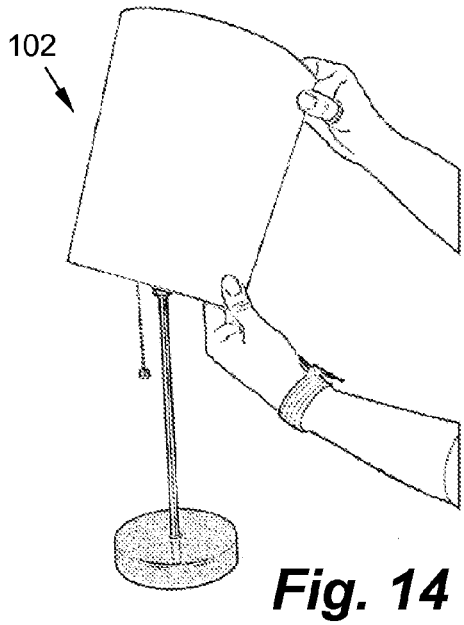
FIG. 14 is a diagrammatic perspective view depicting the deployed shade element receiving the spider element therewithin.

Referring to FIG. 8 for illustration, embodiments of a spider element 130 may include a hub portion 135, a multiplicity of detent elements 136 radially distributed thereabout, and a center aperture 134 therethrough. The hub portion 135 may include an inner portion 180 and a flange portion 182, and may be configured to be removably secured to a lamp base element. Certain embodiments of a spider element 130 may include a multiplicity of arms 132, each extending, for example, radially outwardly from the hub portion 135 to a respective detent element 136. As illustrated in FIG. 8, in particular such embodiments, the arms 132 may extend in generally coplanar fashion with the hub portion 135. In certain embodiments, arms 132 may be hingedly or foldably connected to the hub portion by way of, for example, pin hinges or living hinges (not shown). In embodiments of a spider element having a flange portion 182, the arms 132 may intersect with the flange portion 182 to impart greater structural rigidity between the arms 132 and the hub portion 135.

Figure 15:
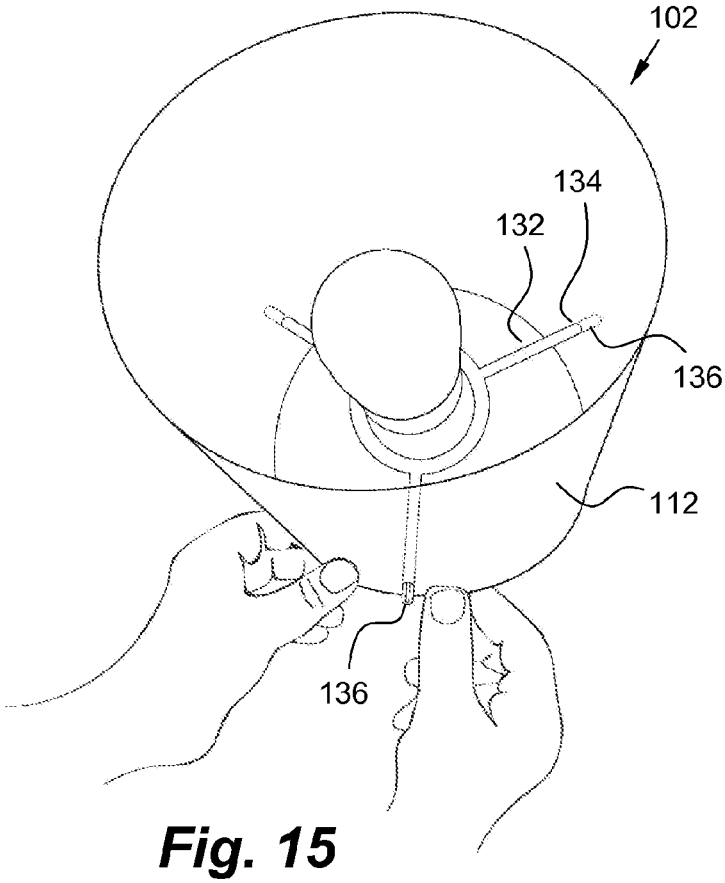
FIG. 15 is a diagrammatic perspective view depicting the detent elements of a spider element being inserted through respective detent apertures of a shade element.
Figure 16:
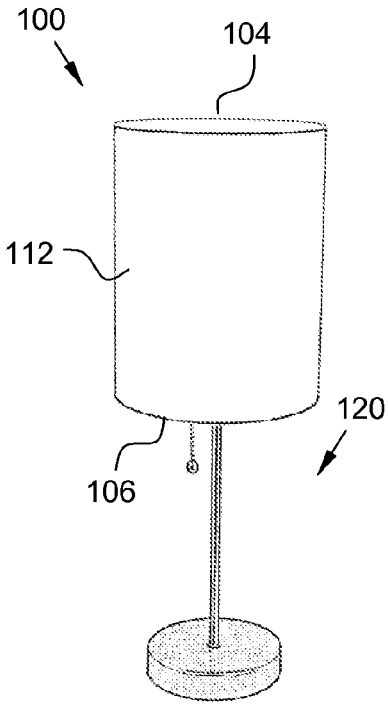
FIG. 16 is a diagrammatic perspective view depicting an embodiment of a fully assembled interchangeable lamp shade kit wherein the arms and detent elements are supporting the shade element.

Referring to FIGS. 9-12 for example, a hub portion 135 is typically adapted to be removably secured to a lamp base element (examples of which are shown at 120*a* and 120*b*) by way of threaded securement of the hub portion 135 on a socket element 124 of the lamp base element. In such embodiments, the direct threaded engagement may preferably occur between the socket thread 126 and a threaded retaining ring 128. However, alternatively or in addition, in certain embodiments the hub portion 135 may be adapted to laterally releasably snappingly engage the lamp base element at, for example, the neck 122 of the lamp base element 120*a* or along the socket element 124. In further alternative, embodiments of a hub portion may include an axially-extending sleeve member (not shown) adapted to threadably or non-threadably receive the socket element for removably securing the hub portion to a lamp base element. The spider element 130 may be formed unitarily by way of injection molding. As illustrated for example in FIGS. 12 and 15, in particular embodiments, one or more detent elements 136 may each comprise a generally vertically-extending notch adapted to receive a portion of the shade element 102 adjacent a respective detent aperture 114.

Figure 2:
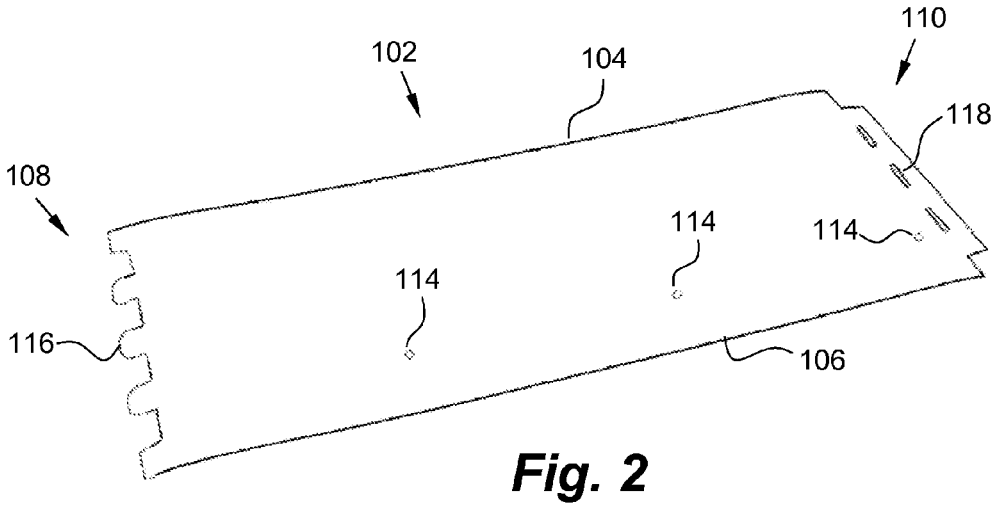
FIG. 2 is a diagrammatic perspective view of the embodiment of FIG. 1.

Referring to FIGS. 1 and 2 for illustration, a shade element 102 may be flexible, translucent, and have at least a flat configuration and a deployed configuration. The shade element may be substantially flat planar in its flat configuration (as illustrated, for example, in FIGS. 1 and 2) and substantially cylindrical in its deployed configuration. The cylindrical shape imparted to the shade element 102 in its deployed configuration may preferably be substantially right circular cylindrical (as illustrated, for example, in FIGS. 13-16), but in certain embodiments may be conically cylindrical or some other known variation of a cylindrical shape. It is contemplated that in an alternative embodiment (not shown), a conical cylindrical shape may be represented by a cone with a substantially closed vertex in which the upper edge 104 is substantially the point of the vertex, and in which one or more venting perforations may be provided in the shade element 102 proximate the upper edge 104. In certain embodiments, a shade element 102 may be made of a resilient polymer such as Polystyrene or the like.

Figure 3:
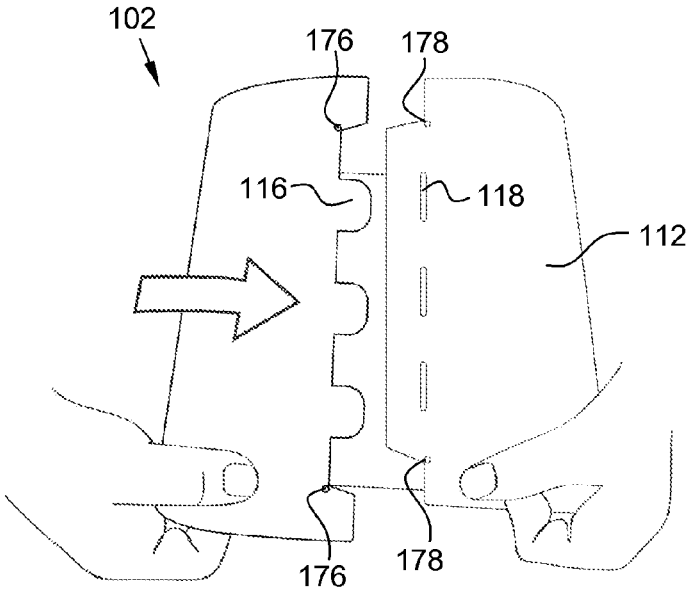
FIG. 3 is a diagrammatic front view of a lamp shade element being flexed toward its deployed configuration for releasable securing engagement between respective first and second securement elements.
Figure 4:
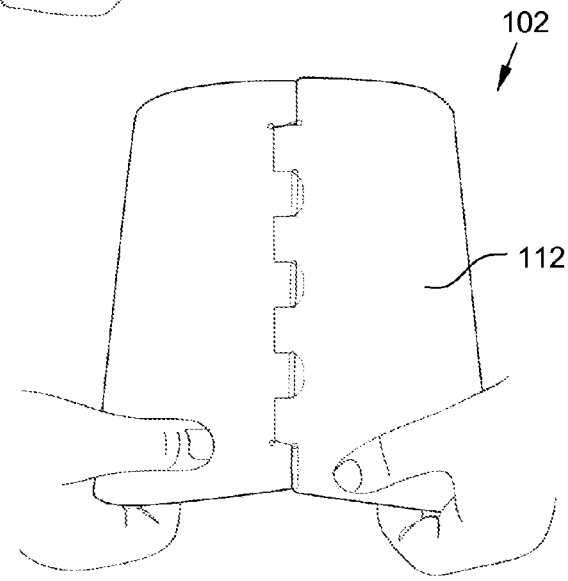
FIG. 4 is a diagrammatic view similar to that of FIG. 3, but in which the respective first and second alignment elements are being moved into releasably engagement with one another in tab-in-slot fashion.
Figure 5:
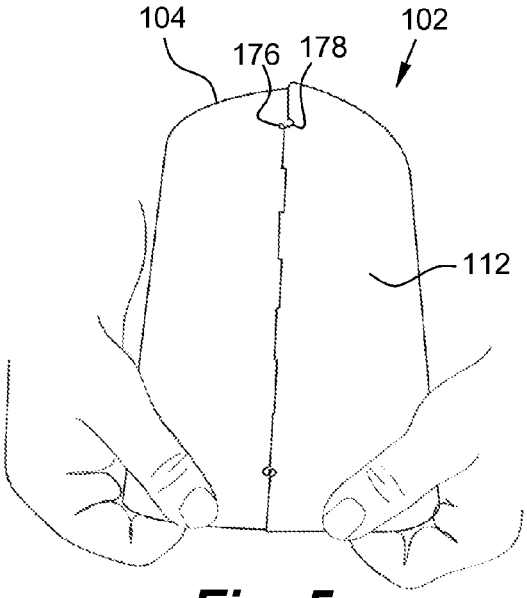
FIG. 5 is a diagrammatic view similar to that of FIG. 4, but in which the first and second securement elements are in releasable engagement with one another.

The shade element 102 may include and upper edge 104, a lower edge 106 and opposing first and second ends (106 and 108 respectively) releasably securable to one another by way of one or more securement elements for releasably retaining the shade element 102 in its deployed configuration. The securement elements are preferably formed integrally with the rest of the shade element 102 as opposed to being one or more separate components. For example, the first end 108 may have one or more first securement elements 176 generally thereat, and the second end 110 may have one or more second securement elements 178 generally thereat. As illustrated for example at FIGS. 3-5, the first securement elements 176 may be configured to releasably engage respective second securement elements 178 for releasably retaining the shade element 102 in its deployed configuration. As a result of such an adaptation, preferred embodiments do not require additional rigid structural elements typically relied on in the prior art to retain the cylindrical shape of the shade element. This also eliminates the need for tapes, fabric strips and other means for securing and cosmetically concealing such rigid structural elements which conventionally tend to obscure or interfere with the continuity of the ornamental pattern depicted on shade element at its top and bottom edges. Thus, the present invention allows the shade element 102 to be repeatedly deployed and flattened by the consumer, while allowing the graphic design 111 of the shade to extend and remain fully viewable from the upper edge 104 all the way to the lower edge 106.

Each shade element 102 is may be adapted to be in receiving engagement with respective detent elements 136. Referring to FIGS. 1 and 2 for example, embodiments of a shade element 102 may include a plurality of detent engagement elements such as detent apertures 114. Such detent engagement elements may be adapted in various ways to be placed in engagement with respective detent elements for providing support of the shade element 102 by the respective spider element 130. For example, referring to FIG. 15, detent apertures 114 may be adapted to be in receiving engagement with respective detent elements 136 for providing, for example, lateral and vertical support of the shade element 102 by the spider element 130. Referring to FIG. 1, in particular embodiments, the detent apertures 114 may be substantially linearly aligned with one another when the shade element 102 is in its flat configuration.

Referring again to FIGS. 1 and 2 for example, in certain embodiments the first end 108 has one or more first alignment elements 116 generally thereat, and the second end 110 has one or more second alignment elements 118 generally thereat. In such embodiments, respective first and second alignment elements 116 and 118 may be configured to releasably engage one another, for example in tab-in-slot or similar fashion.

Figure 17:
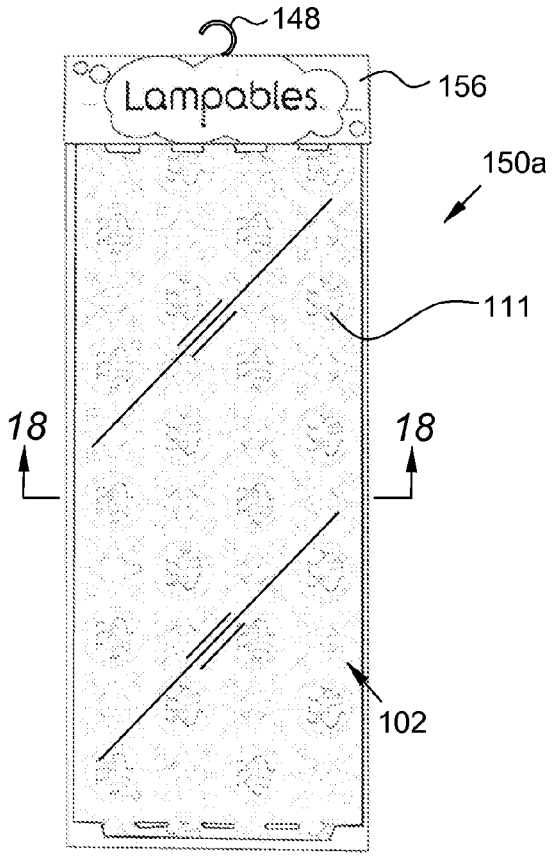
FIG. 17 is a diagrammatic plan view depicting an embodiment of a shade element in flat configuration within a respective shade packaging element having a substantially transparent front package member.
Figure 24:
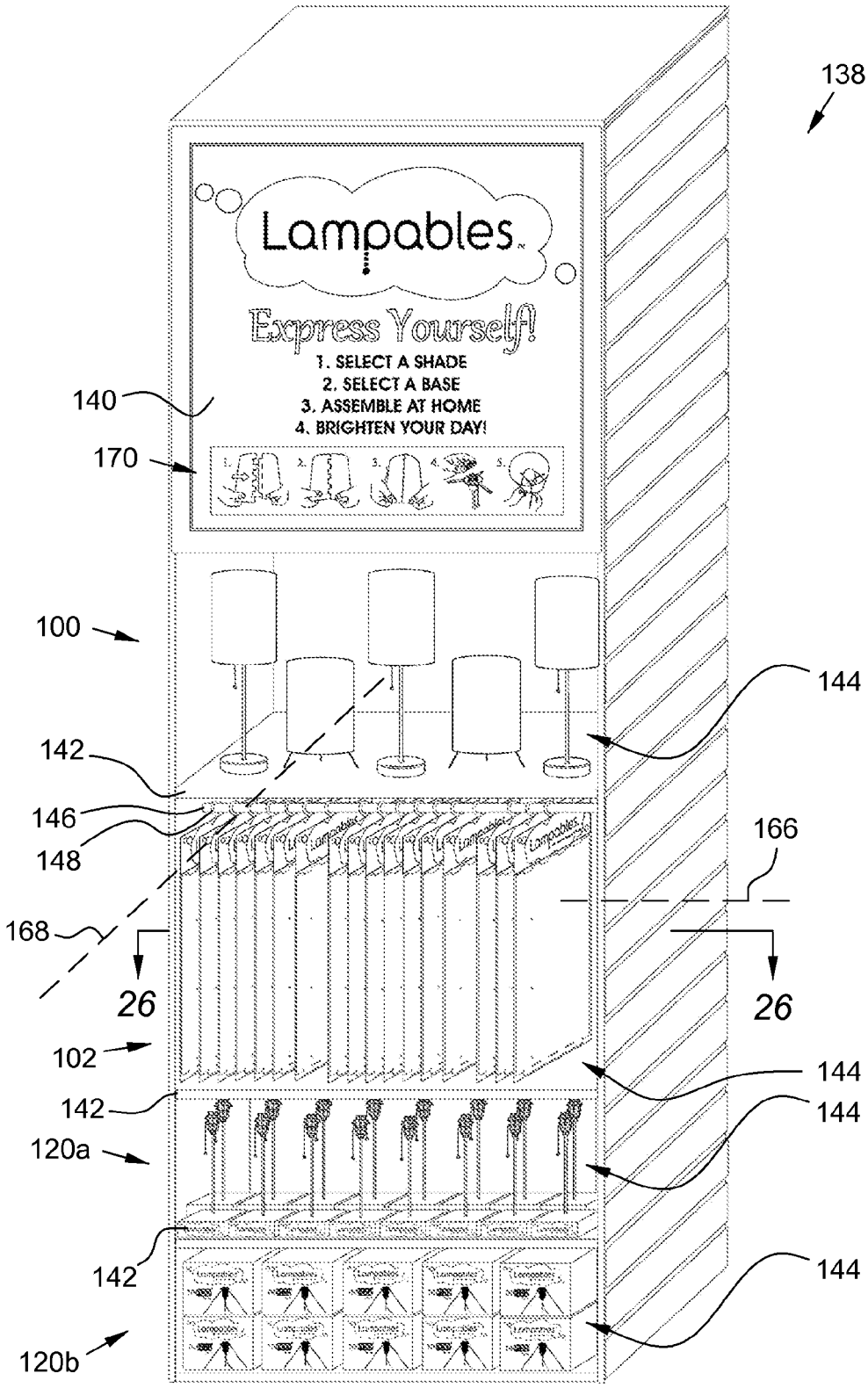
FIG. 24 is a diagrammatic perspective view illustrating one example embodiment of a display system and associated method for collectively displaying components of kits in accordance with the present invention.
Figure 25:
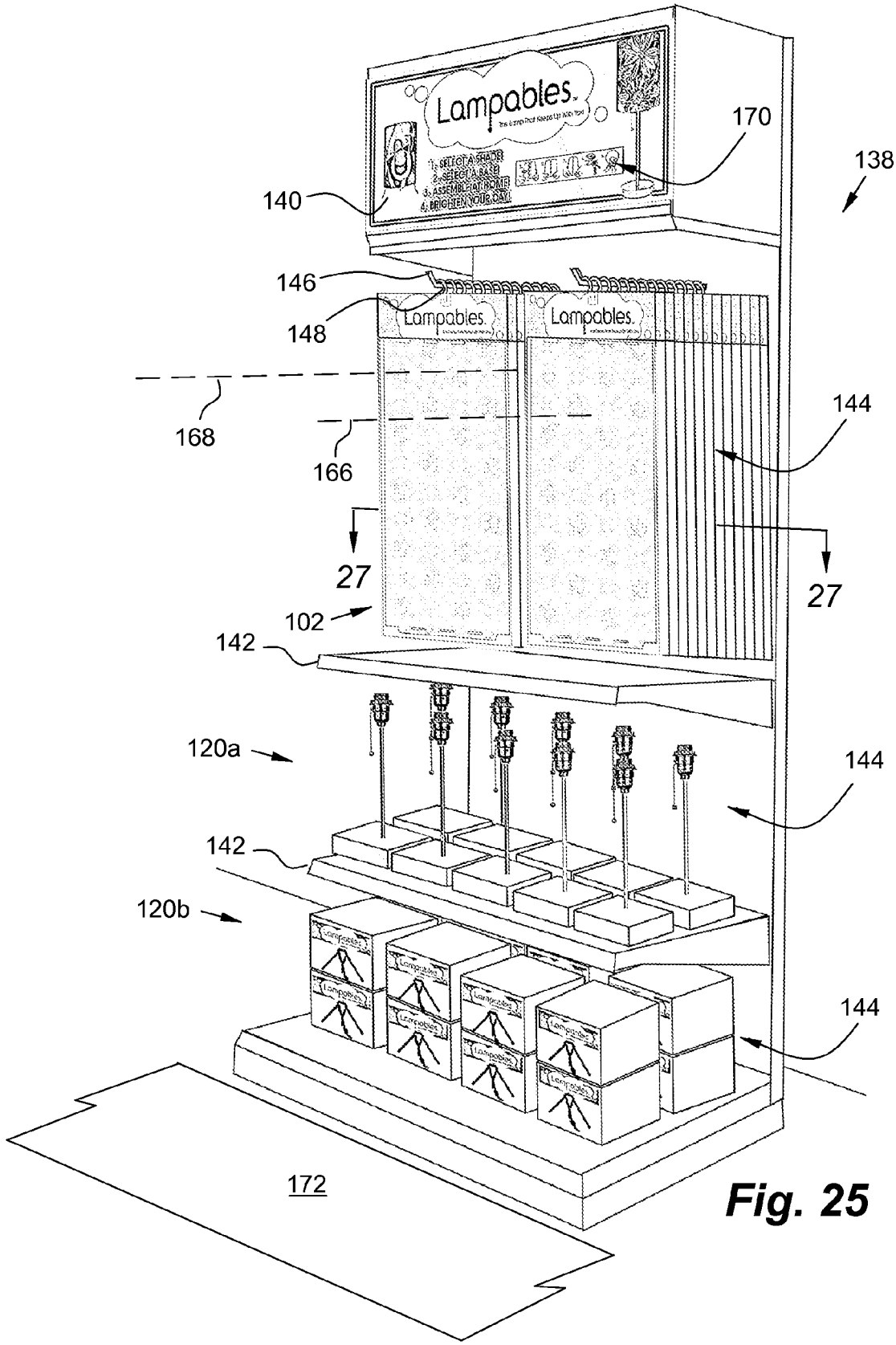
FIG. 25 is a diagrammatic perspective view illustrating another example embodiment of a display system and associated method for collectively displaying components of kits in accordance with the present invention.

Referring to FIGS. 17, 24 and 25 for example, in particular embodiments of a lamp shade kit, a spider element 130 and a shade element 102 may be secured within a packaging element 150*a* with the shade element 102 being in its flat configuration. The spider element in such an embodiment may not be viewable from the front of the packaging, as it may be positioned between the shade element 102 and the rear package member 154. Such a packaging element 150*a* may include a label member 156, and may be adapted to be releasably suspended or otherwise arranged for display of the respective kit in a retail environment. The packaging element may include a hanger portion 148 by which key components of the kit, such as the shade element 102 and spider element 130, may be releasably suspendable for display in a retail environment. In alternative forms, the hangar portion 148 may be, for example, a hook, a loop, a clip, a hook-receiving aperture or cut-out in the label member 156, or the like. In alternative embodiments, a spider element may be packaged with a lamp base element rather than with a shade element.

Figure 18:
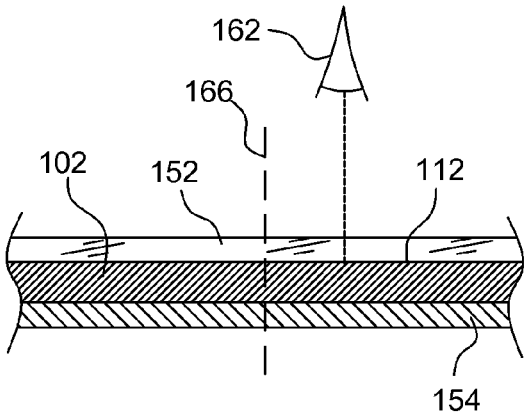
FIG. 18 is a diagrammatic cross-sectional view taken along line 18-18 in FIG. 17.

Referring to FIGS. 17 and 18, preferred embodiments of a shade element 102 include an outer surface 112 having a graphic design 111 printed thereon. The graphic design 111 may comprise a printed pattern, a photographic image, text, trademarks, licensed copyrighted imagery, a combination thereof or the like. In particular embodiments, the outer surface 112 may be adapted to allow a consumer to draw their own design on the shade element using, for example, a dry erase marker. In embodiments which comprise a packaging element 150*a*, the graphic design may be depicted on the packaging element or directly viewable therethrough. For example, the packaging element 150*a* may include a substantially transparent front package member 152 through which the graphic design 111 is viewable by a human eye 162 from a position outward of the front package member 152. In alternative embodiments, the front package member 152 may be substantially opaque, and may depict somewhere thereon the same graphic design as the shade element housed within the packaging. A rear package member 154 may have the same material properties as the respective front package member 152. For example, the front and rear package members may be two joined sheets of a transparent polymer bag within which the shade element 102 and spider element 130 are received and secured for shipping and display purposes.

Figure 19:
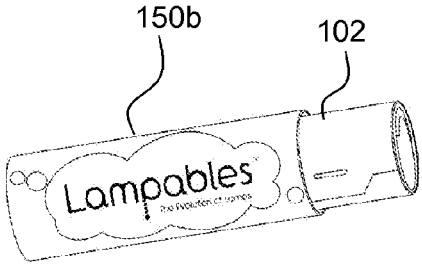
FIG. 19 is a diagrammatic perspective view illustrating an alternative shade packaging element which is generally tubular, and wherein the shade element is stored and shipped in a rolled configuration within the tubular packaging element.
Figure 20:
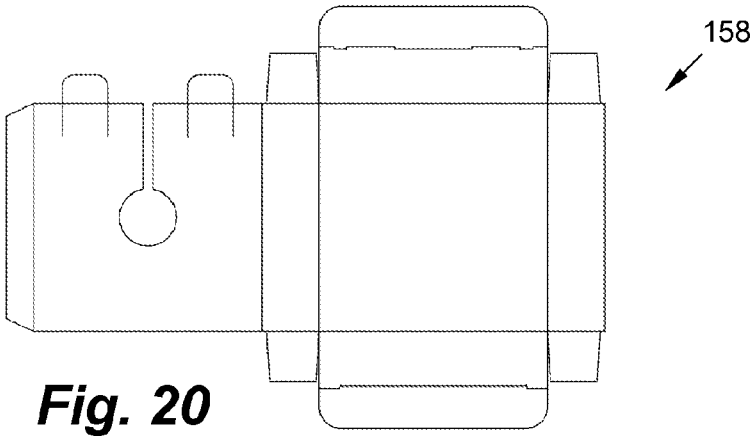
FIG. 20 is a diagrammatic plan view of an embodiment of a protective base sleeve in unfolded or box blank configuration.
Figure 21:
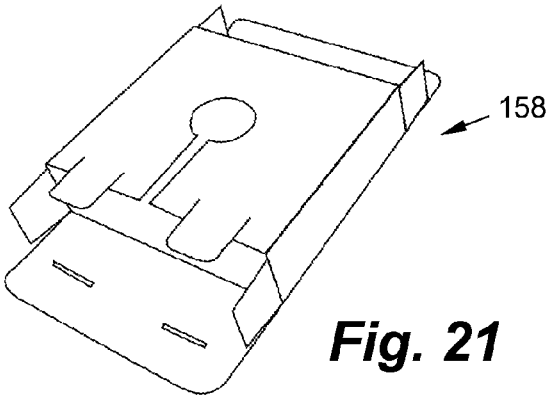
FIG. 21 is a diagrammatic perspective view of the protective base sleeve of FIG. 20, in partially folded and formed configuration.
Figure 22:
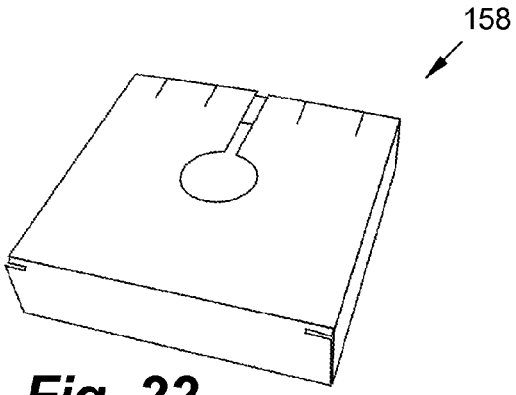
FIG. 22 is a further diagrammatic perspective view of the protective base sleeve of FIG. 20, wherein the sleeve has been completely folded and formed.
Figure 23:
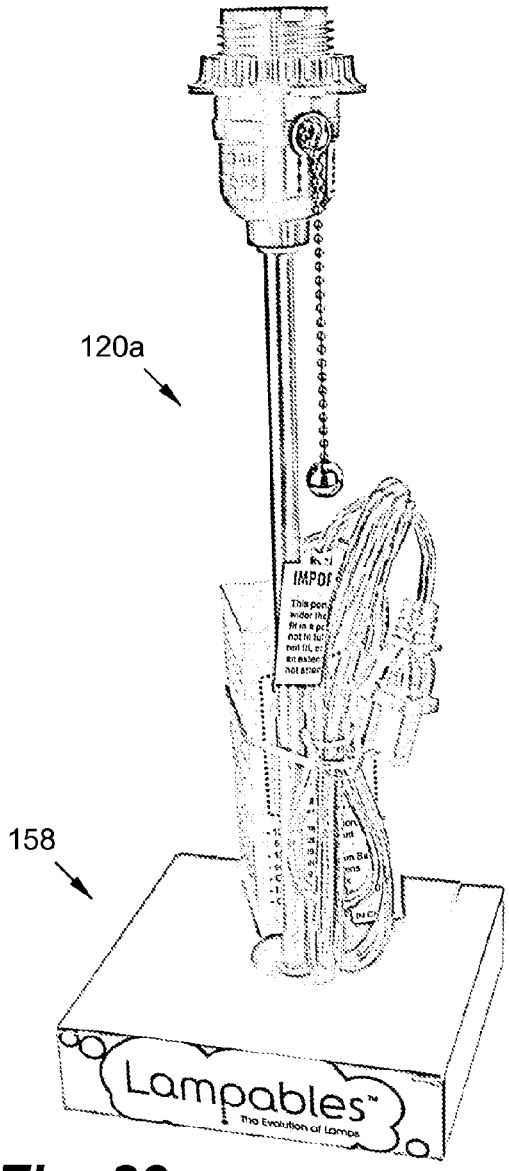
FIG. 23 is a diagrammatic perspective view illustrating the foot of a base element protectedly received within a protective base sleeve for shipment and display.

Referring to FIG. 19 for illustration, in certain embodiments of a kit comprising a packaging element 150*b*, the shade element 102 may be secured within the packaging element 150*b* with the shade element 102 being in a rolled configuration. In such embodiments, the packaging element 150*b* may be generally rigid and tubular. The cross-section of the tubular packaging element 150*b* may be, for example, circular, oval, polygonal or the like. In particular embodiments, a shade element 102 in rolled configuration may be packaged together with a lamp base element, for example, inside the same box.

In certain preferred embodiments, the shade element 102 may be unitarily formed from a sheet of resilient polymer such as Polystyrene or the like. In such embodiments, the shade element 102 may be resiliently biased to return from its deployed configuration toward its flat configuration or its rolled configuration, depending for example, upon the configuration in which the particular shade element was initially packaged, shipped or displayed.

Referring to FIGS. 1-5 for example, in particular embodiments, the first end 108 may have one or more first alignment elements 116 generally thereat, and the second end 110 may have one or more second alignment elements 118 generally thereat. In such embodiments, respective first alignment elements 116 and second alignment elements 118 may be configured to releasably engage one another, for example, in tab-in-slot or similar or equivalent fashion. These alignment elements may be relied on to help guide the first and second securement elements into engagement with one another, and to maintain a substantially uniform and close-fitting alignment between the first end 108 and second end 110 along their respective lengths when the shade element 102 is in its deployed configuration. In certain embodiments, once a shade element is assembled in its deployed configuration, it may be more permanently secured in such configuration with an adhesive, double-sided tape, or the like.

Referring to FIGS. 24 and 25 for example, a system for displaying interchangeable lamp shade kits within a retail environment may comprise an assortment of shade elements 102 and, in preferred embodiments, one or more of a multiplicity of lamp base elements 120*a* and/or 120*b* and a plurality of spider elements 130. The spider elements 130 may be packaged with respective shade elements 102. Corresponding methods of displaying interchangeable lamp shade kits within a retail environment may comprise one or more of the steps of presenting an assortment of shade elements 102, exhibiting a multiplicity of lamp base elements 120*a* and/or 120*b* and providing a plurality of spider elements 130. In such methods, each spider element 130 may be packaged with a respective shade element 102 or provided for sale independently thereof.

Figure 6:
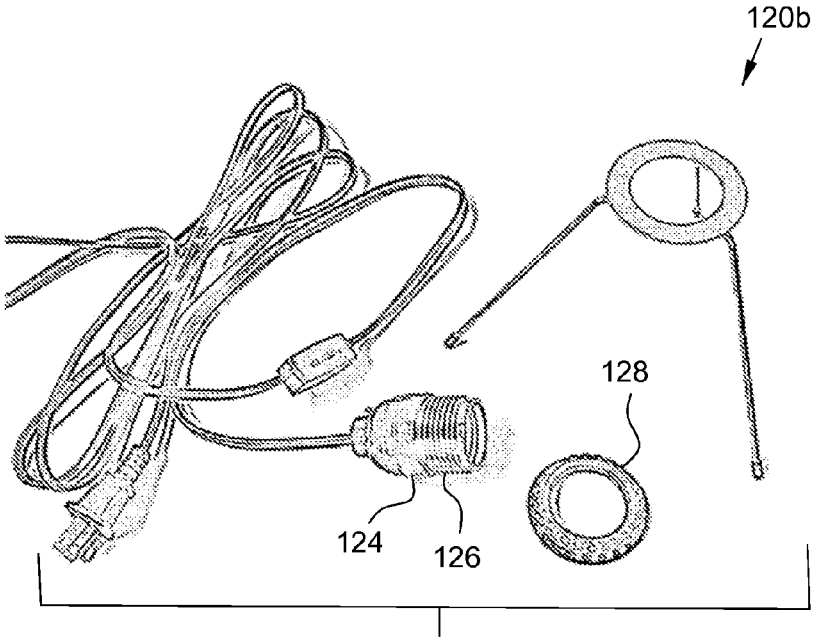
FIG. 6 is a diagrammatic perspective view of components of one example of a tripod-type lamp base element.
Figure 7:
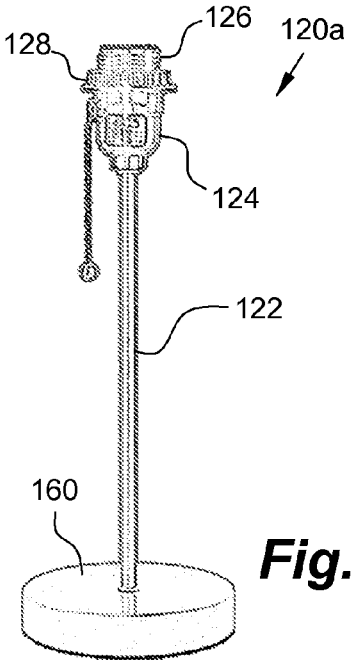
FIG. 7 is a diagrammatic perspective view of components of one example of a stick-type lamp base element.

A multiplicity of lamp base elements may include two or more types. For example, one type of lamp base element is shown in FIG. 7 at 120*a*, and may be referred to as a stick-type lamp base. Another type of lamp base element is depicted in FIG. 6 at 120*b* and may be referred to as a tripod-type lamp base. Further variations may exist. FIGS. 24 and 25 depict how such a multiplicity of lamp base elements (such as those depicted, for example at 120*a* and 120*b*) may be included in a single display system.

Referring to FIG. 8 for example, each spider element 130 may include a hub portion 135 and a multiplicity of detent elements 136 radially distributed thereabout. Each hub portion 135 may be configured to be secured, removably for example, to a lamp base element as described hereinabove.

Referring to FIGS. 17 and 18 for example, in particular embodiments of a system and method for displaying interchangeable lamp shade kits, the shade elements 102 may include an outer surface 112 having a graphic design 111 printed thereon and may each be releasably suspended in their flat configurations for display of the shade elements 102 in a retail environment or otherwise arranged for display of the respective kit or shade element in a retail environment. Each shade element 102 may preferably define a shade planar axis 166 when in its flat configuration.

Referring to FIGS. 24 and 25 for two distinctive examples, certain embodiments of a system and method for displaying interchangeable lamp shade kits may further comprise a selected display fixture or element 138 supportingly presenting the respective lamp base elements (for example, 120*a* and/or 120*b*), spider elements 130 and shade elements 102. Referring to FIGS. 26-29 for examples, a display element 138 may have a viewpoint axis 168 extending outwardly toward a consumer pathway 172 typically adjacent the display element 138. In exemplary embodiments, the display element 138 may be configured as an end-cap, isle or in-line display structure in a retail environment or the like, wherein the passing consumer may easily view and conveniently access the contents of the display element 138. Depending upon the particular embodiment, a display element 138 may preferably be between approximately 36 inches and 72 inches in width. Display elements 138 may comprise one or more shelving elements 142, one or more separate compartments or sections 144, and one or more hanger rod elements (or the like) 146. Embodiments of a hanger rod element 146 may take on a linear, curved, circular, semi-circular, oval, polygonal, or semi-polygonal shape, or the like, and may be adapted to suspendedly support one or more shade elements 102 or respective packaging elements.

Figure 26:
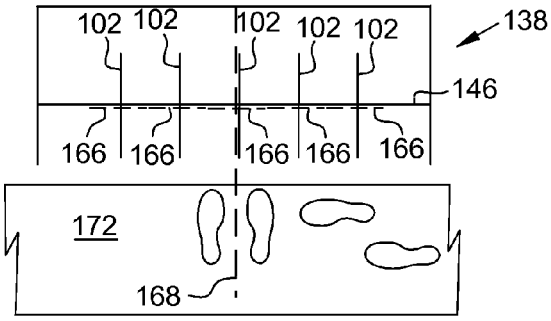
FIG. 26 is a diagrammatic cross-sectional view taken along line 26-26 in FIG. 24, wherein the shade elements are shown arranged in an example of a linear array in which the planar axes of the respective shade elements are substantially parallel to one another and perpendicular to the viewpoint axis of the display element.
Figure 27:
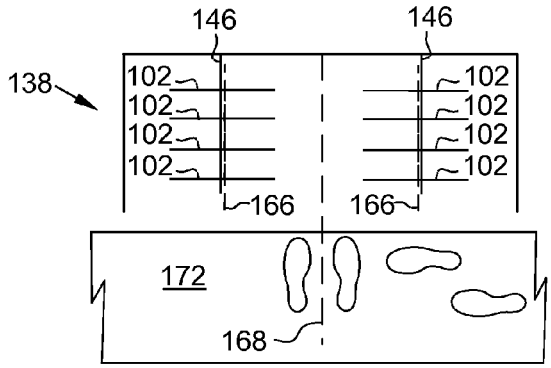
FIG. 27 is a diagrammatic cross-sectional view taken along line 27-27 in FIG. 25, wherein the shade elements are shown arranged in examples of linear arrays in which the planar axes of the respective shade elements are substantially parallel to one another and to the viewpoint axis of the display element.
Figure 28:
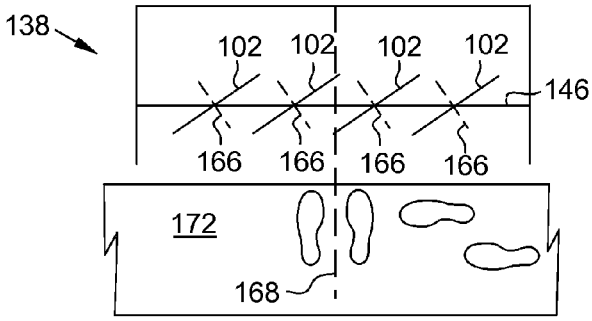
FIG. 28 is a diagrammatic cross-sectional view similar to that of FIG. 26, but in which the planar axes of the respective shade elements are substantially angled with respect to the viewpoint axis of the display element.
Figure 29:
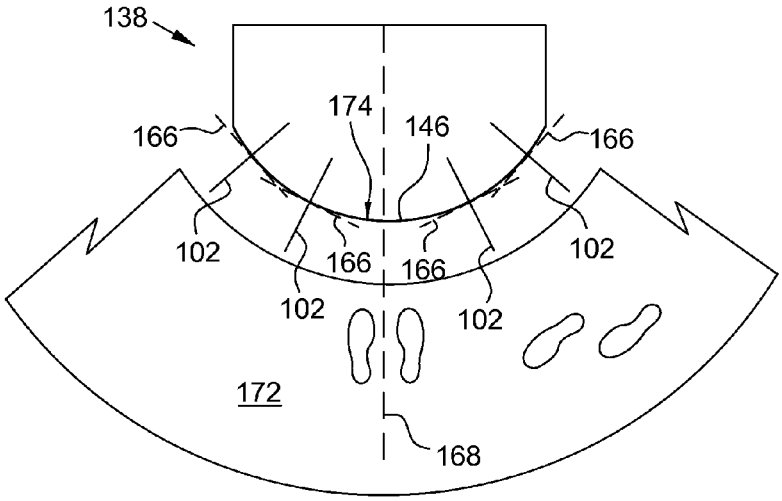
FIG. 29 is a diagrammatic cross-sectional view similar to that of FIG. 26, but in which the shade elements are shown arranged in an example of a curved array in which the respective planar axes are substantially tangential to a particular selected curve.

Referring to FIGS. 24-28 for example, in particular embodiments of a system and method for displaying interchangeable lamp shade kits, the shade elements 102 may preferably be arranged in a linear array in which the planar axes 166 are substantially parallel to one another. In such embodiments, the shade elements 102 may be generally uniformly spaced apart from one another or placed in close or direct contact with one another. Referring to FIGS. 24 and 26 for example, the planar axes 166 may be substantially perpendicular to the viewpoint axis 168. Alternatively, referring to FIGS. 25 and 27 for example, the planar axes 166 may be substantially parallel to the viewpoint axis 168. By way of further alternative example, referring to FIG. 29, the shade elements 102 may be arranged in a curved array in which the planar axes 166 are substantially tangential to a curve 174. Depending up on the particular embodiment, the curve 174 may take on any number of curved shapes, including, for example, semi-circular, compound and three-dimensional curvatures.

Referring to FIGS. 17 and 24 for example, the packaging element 150*a* may include a hanger portion 148 by which key components of the kit, such as the shade element 102 and spider element 130, may be releasably suspendable from, for example, a hanger rod element 146. In alternative forms, the hangar portion 148 may be, for example, a hook, a loop, a hook-receiving aperture through the label member 156, or the like.

Referring to FIGS. 17, 24 and 25, in certain embodiments of a system or method for display, each shade element 102 and a respective spider element 130 may be secured within a respective packaging element 150*a* and may be releasably suspended by way of the respective packaging element 150*a* or may otherwise be generally vertically arrayed or horizontally stacked. In embodiments with packaging elements 150*a*, each graphic design 111 may be depicted on the respective packaging element 150*a* (for example, on the outside surface of an otherwise generally opaque packaging element) or may be directly viewable therethrough. By providing an assortment of shade elements 102 in closely arrayed or stacked fashion, embodiments of the display systems and methods in accordance with the present invention may persuade the passing consumer to pause their movement, move in closer to the lamp kit display, and spend time interacting with the lamp kits by, for example, leafing through the assortment of shade elements. As a result, the consumer is compelled to invest more time and attention in the lamp kits for sale, thereby increasing the likelihood that a respective sale will be completed.

Referring to FIGS. 24 and 25 for example, a display element 138 may include a signage portion 140, such as a header sign. Such a signage portion 140 may have a set of sequenced illustrations 170 instructing how to assemble one of the lamp shade elements 102 with a respective lamp base element (120*a* or 120*b* for example) and spider element 130. In particular embodiments of a display system or method, such as the one depicted in FIG. 24 for example, one or more fully-assembled lamps 100 formed from kits in accordance with the present invention may be exhibited for illustrative purposes.

Referring to FIGS. 7 and 20-25 for example, in certain embodiments at least some of the base elements 120*a* may have a foot portion 160 and a respective protective base sleeve 158 removably enveloping the foot portion 160. Embodiments of a protective base sleeve may be made from, for example, cardboard or paperboard. Referring to FIGS. 24 and 25 for example, this protective sleeve may allow base elements, such as those shown at 120*a*, to be shipped and displayed in close proximity to one another without resulting in surface damage to the foot portions.

Referring to FIGS. 24 and 25 for illustration, in particular embodiments, the shade elements 102 and base elements may be disposed in separate respective sections 144 of the display element 138 while being simultaneously viewable by a consumer positioned on a pathway 172, for example, along a viewpoint axis 168.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An interchangeable lamp shade kit comprising:

a spider element including a hub portion and a multiplicity of detent elements radially distributed thereabout, said hub portion being configured to be removably secured to a lamp base element; and a shade element being flexible and having at least a flat configuration and a deployed configuration, said shade element being substantially flat planar in its flat configuration and substantially cylindrical in its deployed configuration, said shade element including opposing first and second ends, said first end having one or more first securement elements generally thereat, said second end having one or more second securement elements generally thereat, said first securement elements being configured to releasably engage respective said second securement elements for releasably retaining said shade element in its deployed configuration, said shade element including a plurality of detent apertures adapted to be in receiving engagement with respective said detent elements for providing at least lateral and vertical support of said shade element by said spider element.

2. An interchangeable lamp shade kit as defined in claim 1 wherein said shade element is unitarily formed from a sheet of resilient polymer.

3. An interchangeable lamp shade kit as defined in claim 1 wherein said detent apertures are substantially linearly aligned with one another when said shade element is in its flat configuration.

4. An interchangeable lamp shade kit as defined in claim 1 wherein said shade element is resiliently biased to return from its deployed configuration toward its flat configuration.

5. An interchangeable lamp shade kit as defined in claim 1 wherein said first end has one or more first alignment elements generally thereat, said second end has one or more second alignment elements generally thereat, and respective said first and second alignment elements are configured to releasably engage one another in tab-in-slot fashion.

6. An interchangeable lamp shade kit as defined in claim 1 wherein said spider element and said shade element are secured within a packaging element with said shade element being in its flat configuration, said packaging element being adapted to be releasably suspended for display of said kit in a retail environment.

7. An interchangeable lamp shade kit as defined in claim 6 wherein said shade element includes an outer surface having a graphic design printed thereon, and said packaging element includes a substantially transparent front package member through which said graphic design is viewable by a human eye from a position outward of said front package member.

8. An interchangeable lamp shade kit as defined in claim 1 wherein said shade element is secured within a packaging element with said shade element being in a rolled configuration, said packaging element being generally rigid and tubular.

9. An interchangeable lamp shade kit as defined in claim 1 wherein said spider element includes a multiplicity of arms, each said arm extending radially outwardly from said hub portion to a respective said detent element, said arms extending generally coplanar with said hub portion.

10. An interchangeable lamp shade kit as defined in claim 1 wherein said hub portion is adapted to be releasably secured to said lamp base element by way of threaded securement of said hub portion on a socket element of said lamp base element.

11. An interchangeable lamp shade kit as defined in claim 1 wherein said spider element is formed unitarily by way of injection molding.

12. An interchangeable lamp shade kit as defined in claim 1 wherein said detent elements each comprise a generally vertically-extending notch adapted to receive a portion of said shade element adjacent a respective said detent aperture.

13. An interchangeable lamp shade kit as defined in claim 1 in wherein said shade element is substantially right circular cylindrical in its deployed configuration.

14. An interchangeable lamp shade kit comprising:

a shade element being flexible, translucent and having at least a flat configuration and a deployed configuration, said shade element being substantially flat planar in its flat configuration and substantially cylindrical in its deployed configuration, said shade element including opposing first and second ends, said first end having one or more first securement elements generally thereat, said second end having one or more second securement elements generally thereat, said first securement elements being configured to releasably engage respective said second securement elements for releasably retaining said shade element in its deployed configuration, said first end having one or more first alignment elements generally thereat, said second end having one or more second alignment elements generally thereat, respective said first and second alignment elements being configured to releasably engage one another in tab-in-slot fashion, said shade element including a plurality of detent apertures adapted to be in receiving engagement with respective detent elements of a spider element for providing at least lateral and vertical support of said shade element by said spider element, said shade element being unitarily formed from a sheet of resilient polymer and including an outer surface having a graphic design printed thereon.

15. An interchangeable lamp shade kit as defined in claim 14 wherein said shade element is secured within a packaging element with said shade element being in its flat configuration, said packaging element having a hanger portion by which said kit is releasably suspendable for display in a retail environment.

16. An interchangeable lamp shade kit as defined in claim 15 wherein said packaging element includes a substantially transparent front package member through which said graphic design is viewable by a human eye from a position outward of said front package member.

17. An interchangeable lamp shade kit as defined in claim 14 wherein said shade element is secured within a packaging element with said shade element being in a rolled configuration, said packaging element being generally rigid and tubular.

18. An interchangeable lamp shade kit as defined in claim 14 further comprising a said spider element, wherein said spider element is formed unitarily by way of injection molding and includes a hub portion and a multiplicity of arms, each said arm extending radially outwardly from and generally coplanar with said hub portion to a respective said detent element, said hub portion being configured to be removably secured to a lamp base element, said detent elements each comprising a generally vertically-extending notch adapted to receive a portion of said shade element adjacent a respective said detent aperture.

19. An interchangeable lamp shade kit as defined in claim 18 wherein said spider element and said shade element are secured within a packaging element with said shade element being in its flat configuration, said packaging element being adapted to be releasably suspended for display of said kit in a retail environment, said graphic design being depicted on said packaging element or directly viewable therethrough.

20. An interchangeable lamp shade kit comprising:

a shade element being flexible, translucent and having at least a flat configuration and a deployed configuration, said shade element being substantially flat planar in its flat configuration and substantially cylindrical in its deployed configuration, said shade element including opposing first and second ends releasably securable to one another by way of one or more securement elements for releasably retaining said shade element in its deployed configuration, said shade element including a plurality of detent apertures adapted to be in receiving engagement with respective detent elements of a spider element for providing support of said shade element by said spider element, said shade element being unitarily formed from a sheet of resilient polymer and including an outer surface having a graphic design printed thereon.

21. A system for displaying interchangeable lamp shade kits within a retail environment, said system comprising:

a multiplicity of lamp base elements;

a plurality of spider elements, each said spider element including a hub portion and a multiplicity of detent elements radially distributed thereabout, each said hub portion being configured to be removably secured to a lamp base element; and an assortment of shade elements, each said shade element being flexible and having at least a flat configuration and a deployed configuration, each said shade element being substantially flat planar in its flat configuration and substantially cylindrical in its deployed configuration, each said shade element including opposing first and second ends, said first end having one or more first securement elements generally thereat, said second end having one or more second securement elements generally thereat, said first securement elements being configured to releasably engage respective said second securement elements for releasably retaining said shade element in its deployed configuration, each said shade element including a plurality of detent apertures adapted to be in receiving engagement with respective said detent elements for providing at least lateral and vertical support of said shade element by respective said spider element;

wherein said shade elements include an outer surface having a graphic design printed thereon and are each releasably suspended in their flat configurations for display of said shade elements in a retail environment, each said shade element defining a shade planar axis when in its flat configuration.

22. A system as defined in claim 21 further comprising a display element supportingly presenting said lamp base elements, spider elements and shade elements, said display element having a viewpoint axis extending outwardly toward a consumer pathway adjacent said display element.

23. A system as defined in claim 22 wherein said shade elements are arranged in a linear array in which said planar axes are substantially parallel to one another.

24. A system as defined in claim 23 wherein said planar axes are substantially perpendicular to said viewpoint axis.

25. A system as defined in claim 23 wherein said planar axes are substantially parallel to said viewpoint axis.

26. A system as defined in claim 21 wherein said shade elements are arranged in a curved array in which said planar axes are substantially tangential to a curve.

27. A system as defined in claim 21 wherein each said shade element and a respective said spider element are secured within a respective packaging element and are releasably suspended by way of said respective packaging element, each said graphic design being depicted on its respective said packaging element or being directly viewable therethrough.

28. A system as defined in claim 21 wherein said shade element is unitarily formed from a sheet of resilient polymer.

29. A system as defined in claim 21 wherein said spider element is formed unitarily by way of injection molding and said detent elements each comprise a generally vertically-extending notch adapted to receive a portion of a respective said shade element adjacent a respective said detent aperture.

30. A system as defined in claim 21 wherein said display element includes a signage portion having a set of sequenced illustrations instructing how to assemble one of said lamp shade elements with a respective said lamp base element and spider element.

31. A system as defined in claim 21 wherein at least some of said lamp base elements have a foot portion and a respective protective base sleeve removably enveloping said foot portion.

32. A system as defined in claim 21 wherein respective said first end has one or more first alignment elements generally thereat, said second end has one or more second alignment elements generally thereat, respective said first and second alignment elements being configured to releasably engage one another in tab-in-slot fashion.

33. A system for displaying interchangeable lamp shade kits within a retail environment, said system comprising:

a multiplicity of lamp base elements;

a plurality of spider elements, each said spider element including a hub portion and a multiplicity of detent elements radially distributed thereabout, each said hub portion being configured to be removably secured to a lamp base element having a socket element;

an assortment of shade elements, each said shade element being flexible, translucent and having at least a flat configuration and a deployed configuration, each said shade element being substantially flat planar and thereby defining a shade planar axis in its flat configuration and being substantially cylindrical in its deployed configuration, each said shade element including opposing first and second ends and an outer surface having a graphic design thereon, said first end having one or more first securement elements generally thereat, said second end having one or more second securement elements generally thereat, said first securement elements being configured to releasably engage respective said second securement elements for releasably retaining said shade element in its deployed configuration, each said shade element including a plurality of detent engaging elements adapted to be in engagement with respective said detent elements for providing support of said shade element by respective said spider element; and a display element supportingly presenting said lamp base elements, spider elements and shade elements, said display element including a signage portion having a set of sequenced illustrations instructing how to assemble one of said lamp shade elements with a respective said lamp base element and spider element, said display element having a viewpoint axis extending outwardly toward a consumer pathway adjacent said display element;

wherein each said shade element and a respective said spider element is secured within a respective packaging element and releasably suspended thereby, each said graphic design being depicted on its respective said packaging element or being directly viewable therethrough.

34. A system as defined in claim 33 in which said shade elements and lamp base elements are disposed in respective sections of said display element and are simultaneously viewable by a consumer positioned on said pathway along said viewpoint axis.

35. A system as defined in claim 33 wherein said spider element is formed unitarily by way of injection molding and said detent elements each comprise a generally vertically-extending notch adapted to receive a portion of a respective said shade element adjacent a respective said detent aperture.

36. A system as defined in claim 33 wherein said shade elements are arranged in a linear array in which said planar axes are substantially parallel to one another, said planar axes further being substantially perpendicular or parallel to said viewpoint axis.

37. A system for displaying interchangeable lamp shade kits within a retail environment, said system comprising:

a multiplicity of lamp base elements;

a plurality of spider elements, each said spider element including a hub portion and a multiplicity of detent elements radially distributed thereabout, each said hub portion being configured to be secured to a lamp base element; and an assortment of shade elements, each said shade element being flexible and having at least a flat configuration and a deployed configuration, each said shade element being substantially flat planar in its flat configuration and substantially cylindrical in its deployed configuration, each said shade element including opposing first and second ends being releasably securable to one another by way of one or more securement elements for releasably retaining respective said shade element in its deployed configuration, each said shade element being adapted to be in receiving engagement with respective said detent elements for providing support of said shade element by respective said spider element;

wherein said shade elements include an outer surface having a graphic design printed thereon and are each presented in their flat configurations thereby defining respective shade planar axes, said shade elements being arranged in a linear array in which said planar axes are substantially parallel to one another.

* * * * *